US006659109B2

(12) United States Patent
Noa

(10) Patent No.: US 6,659,109 B2
(45) Date of Patent: Dec. 9, 2003

(54) POWDER PUFF DEVICE FOR A RECEPTACLE

(75) Inventor: Byong Hoo Noa, Seoul (KR)

(73) Assignee: Sunghansponge Co., Ltd., Gyunggi-do (KR)

( * ) Notice: Subject to any disclaimer, the term of this patent is extended or adjusted under 35 U.S.C. 154(b) by 0 days.

(21) Appl. No.: 10/003,444

(22) Filed: Dec. 6, 2001

(65) Prior Publication Data

US 2003/0041872 A1 Mar. 6, 2003

(30) Foreign Application Priority Data

Aug. 28, 2001 (KR) ..... 2001-26125
Oct. 25, 2001 (KR) ..... 2001-32659

(51) Int. Cl.[7] ..... A45D 40/24
(52) U.S. Cl. ..... 132/317
(58) Field of Search ..... 132/317, 318, 132/320, 313, 303, 299, 298, 293; 15/229.14, 208; 428/220; 401/196, 202, 268, 269, 118, 126

(56) References Cited

U.S. PATENT DOCUMENTS

| | | | | | |
|---|---|---|---|---|---|
| 1,612,593 | A | * | 12/1926 | McDougall | 132/317 |
| 1,852,566 | A | * | 4/1932 | Harrison | 15/229.14 |
| 2,100,855 | A | * | 11/1937 | Kelly | 132/298 |
| 3,167,806 | A | * | 2/1965 | Hogan | 132/298 |
| 3,592,202 | A | * | 7/1971 | Jones | 132/317 |
| 3,729,011 | A | * | 4/1973 | Gleicher | 132/317 |
| 5,873,670 | A | * | 2/1999 | Spivey et al. | 401/126 |
| 6,234,181 | B1 | * | 5/2001 | Lou | 132/313 |
| 6,363,948 | B2 | * | 4/2002 | Choi | 132/313 |

* cited by examiner

*Primary Examiner*—John J. Wilson
*Assistant Examiner*—Robyn Kieu Doan
(74) *Attorney, Agent, or Firm*—Birch, Stewart, Kolasch & Birch, LLP

(57) ABSTRACT

A powder puff device containing a powder receptacle which includes a puff unit having a cover, and a receptacle unit having an outlet channel for exhausting the powder from a receptacle which contains powder to the cover of the puff unit whereby a composite unit of the puff unit and the receptacle unit can be easily and conveniently used to make up the user's face anywhere and anytime.

9 Claims, 3 Drawing Sheets

POWDER PUFF DEVICE FOR A RECEPTACLE

BACKGROUND OF THE INVENTION

1. Field of the Invention

The present invention relates to an improved powder puff device containing a receptacle and more particularly to a powder puff device having a receptacle for the powder for easily and effectively dispensing the powder into the powder puff for immediate applications.

2. Description of Related Art

Various types of powder puff devices are known in the art. Generally, a conventional compact comprises a powder holding receptacle and a separate powder puff. In use, the user presses the powder puff on the powder located in a receptacle.

However, such a conventional compact suffers from a number of problems. For example, when such a conventional compact is carried in a handbag, movement of the handbag can cause the powder in the receptacle to leak out, creating a mess.

In order to solve such a problem, the user can use a puff and a separate powder case. However, it is difficult and inconvenient in certain situations to apply make-up by inserting the powder puff into the powder receptacle, for example, when riding in moving cars, ships or airplanes. In such situations, the powder receptacle can fall causing the powder to scatter throughout the area.

SUMMARY OF THE INVENTION

Accordingly, it is an object of the present invention to provide a powder puff device for a receptacle which eliminates the above problems encountered with conventional powder puff devices.

Another object of the present invention is to provide a powder puff device including a case for holding the powder and a puff assembled with the case for conveniently carrying it in a handbag during a trip.

A further object of the present invention is to provide a puff device for a receptacle which includes a case having an outlet channel for exhausting the powder from the case, a middle case, a lower case, a belt-type project disposed in the lower case, a cover, a cap and a mirror disposed on the inside or outside of the cap whereby the device for powdering the user's face includes a composite unit of the puff and the powder receptacle for using the powder on the puff directly.

Still another object of the present invention is to provide a powder puff device containing a powder receptacle which is simple in structure, inexpensive to manufacture, durable in use and refined in appearance.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

Briefly described, the present invention is directed to a powder puff device containing a powder receptacle which includes a puff unit having a cover, and a receptacle unit having an outlet channel for exhausting the powder from a receptacle which contains powder to the cover of the puff unit whereby a composite unit of the puff unit and the receptacle unit can be easily and conveniently used to make up the user's face anywhere and anytime.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
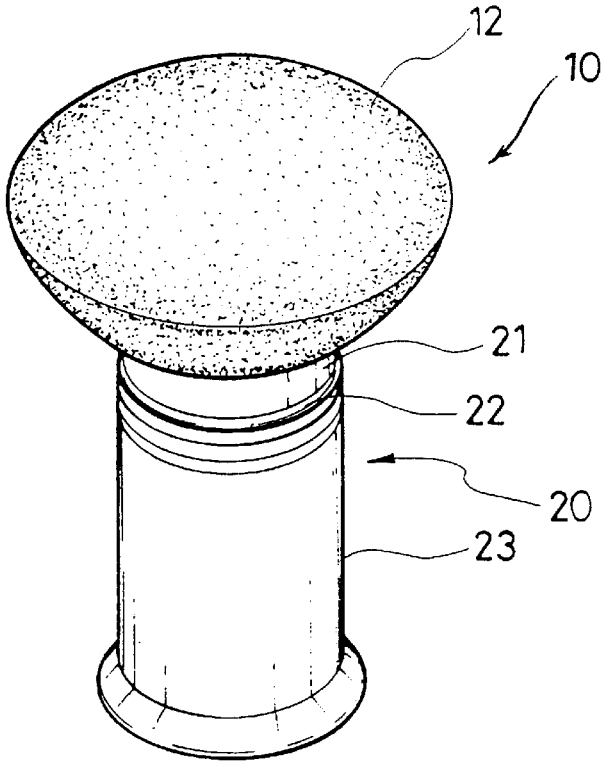
FIG. 1 is a perspective view of a powder puff device containing a powder receptacle according to the present invention.
Figure 2:
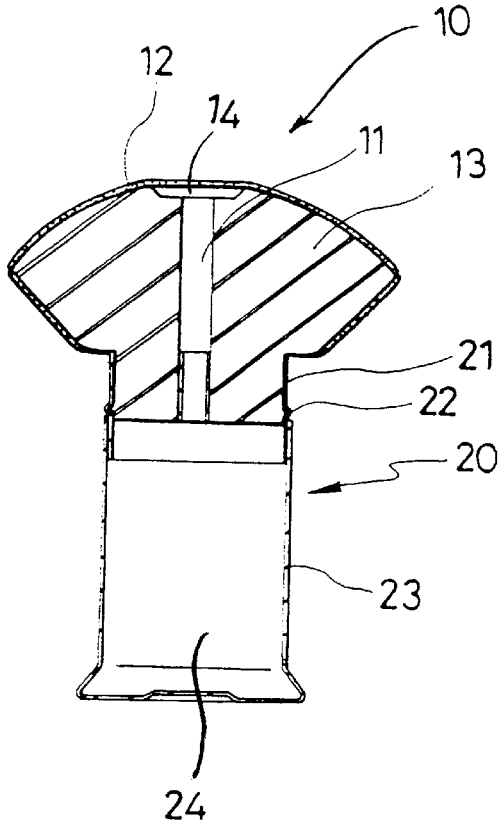
FIG. 2 is a sectional view of FIG. 1.

Referring now in detail to the drawings for the purpose of illustrating preferred embodiments of the present invention, the powder puff device as shown in FIGS. 1 and 2 includes a case member 20 and a puff member 10 having a powder puff 13 mounted on the top of the case member 20 to define a composite unit. The case 20 includes a middle case 21 for engaging with the puff 10 disposed therein and a lower case 23 defining a receptacle 24 for storing the cosmetic powder (not shown) therein. The middle case 21 is engageable and disengageable with the lower case 23 at a raised bead portion 22 disposed at the circumference of the middle case 21. The raised bead portion 22 of the middle case 21 permits ready access to the lower case 23.

The puff member 10 mounted on the middle case 21 of the case member 20 includes a cover 12 for covering the surface of the powder puff 13 of the puff member 10 so as to prevent its contamination by the air and/or environmental pollution. The cover 12 has a sufficient porosity to enable the cosmetic powder to flow through its pores when the powder puff 13 is applied to the face of the user. An outlet channel 11 passes through the center of the puff 13 of the puff member 10 and the middle case 21 and communicates with the cosmetic powder in the receptacle 24 of the lower case 23. A small chamber 14 is provided at the end of the channel 11 for distributing cosmetic powder to the surface cover 12 of the puff 13.

Figure 3:
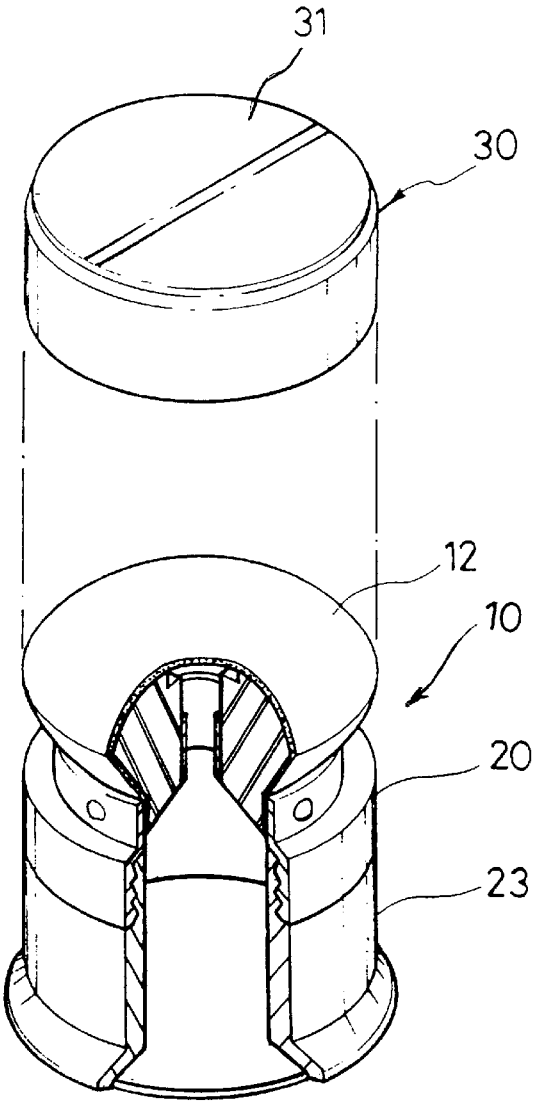
FIG. 3 is a perspective view of the powder puff device for a receptacle according to the present invention.

In FIG. 3, a smaller diameter puff is utilized so that a cap 30 can cover the puff and be secured to the case member 20. A mirror 31 can be provided in the inside or outside of the cap 30 to observe the face after the powder has been applied.

Figure 4:
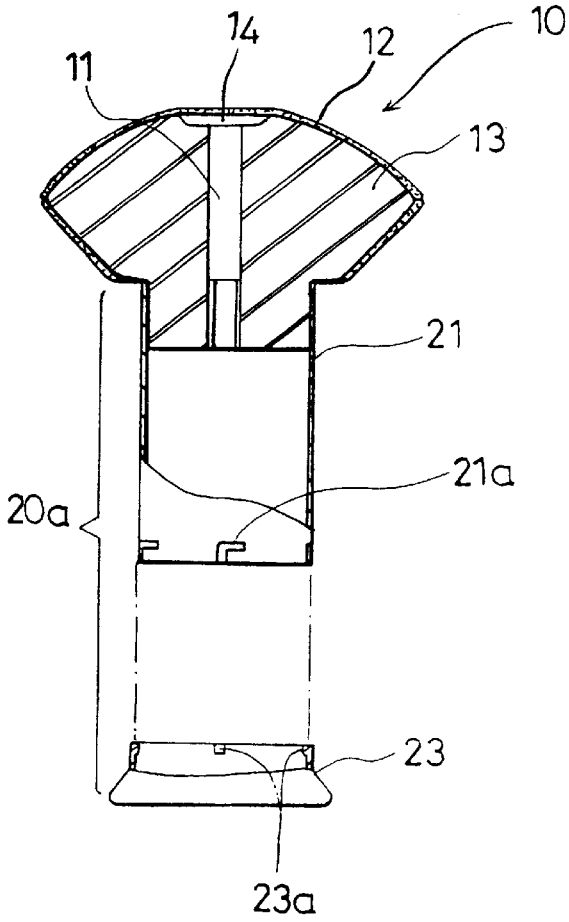
FIG. 4 is a sectional view of a second embodiment of the powder puff device for a receptacle according to the present invention.

Referring in detail to FIG. 4, there is illustrated a second embodiment of the powder puff device in accordance with the present invention. The powder puff device includes the puff member 10 mounted on a case member 20*a* containing an elongated middle case 21 and a lower case 23 which engages with the elongated middle case 21 by a plurality of "L"-shaped locking grooves 21*a* disposed at the lower portion of the middle case 21 and a plurality of projections 23*a* disposed at the upper portion of the lower case 23. The other elements of the puff member 10 as shown in FIG. 4 are the same as the elements 11, 12, 13 and 14 of the puff member 10 as shown in FIGS. 1 and 2.

Figure 5:
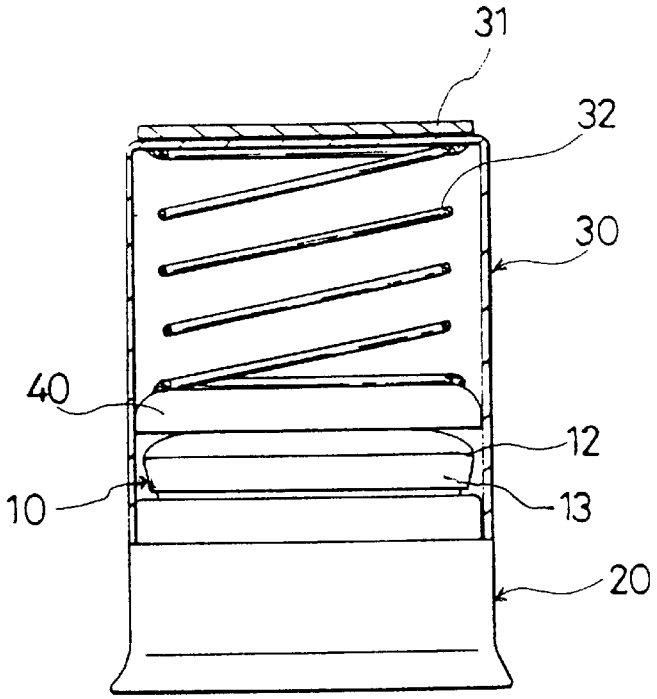
FIG. 5 is a sectional view of a third embodiment of the powder puff device for a receptacle according to the present invention.

Referring in detail to FIG. 5, there is illustrated a third embodiment of the powder puff device of the present invention. The powder puff device includes a case 20 and a cap 30 engaged with the case 20. The cap 30 has a mirror 31 provided on the outside thereof. A solid powder receptacle 40 for storing and dispensing a solid cosmetic powder is attached to a spring 32 which in turn is attached to the inside of the cap 30. The powder puff 13 containing a cover 12 is attached to the case 20 so that when the cap 30 is attached to the case 20, the spring 32 biases the cosmetic against the puff 13 and loads the puff 13 with cosmetic. When the cap 30 is removed from the case 20, the cosmetic powder delivered from the receptacle 40 to the powder puff 13 by the biasing action of the spring 32 is ready to be applied to the face of the user.

Figure 6:
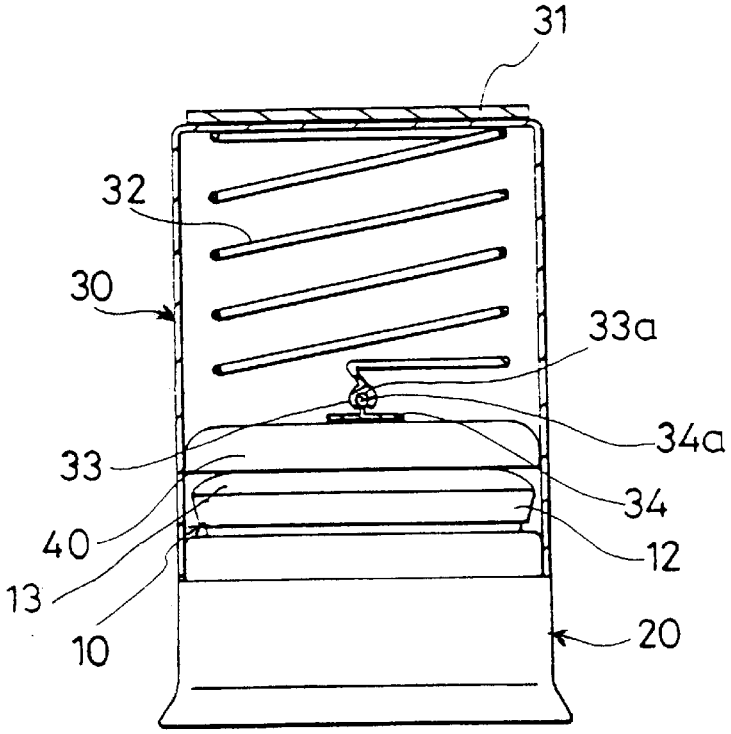
FIG. 6 is a sectional view of a fourth embodiment of the powder puff device for a receptacle according to the present invention.

In FIG. 6, the powder puff device is the same as the powder puff device as shown in FIG. 5. With the exception that the spring 32 is not fixed to the solid powder receptacle 40, thereby making the powder receptacle 40 replaceable. Thus, an additional member 33, which contains a receiver 33*a* is provided for receiving an inserting ball 34*a* extending from a latch 34. The latch 34 has the inserting ball 34*a* mounted on the outside of the solid powder receptacle 40. The other elements of the powder puff device as shown in FIG. 6 are the same as the elements 12, 13, 30, 31, 32 of the powder puff device as shown in FIG. 5.

Referring in detail to FIGS. 1, 2, 3 and 4, in order to load the cosmetic powder into the receptacle 24 of the lower case 23, the lower case 23 is removed from the middle case 21, and the cosmetic powder is added to the receptacle 24, after which the lower case 23 is pushed into the middle case 21 until the raised portion 22 is engaged.

When the cosmetic powder in the receptacle 24 is exhausted, the user can add to the receptacle 24. When the cover 12 becomes dirty, the cover 12 can be removed and washed and reapplied to the powder puff 13. When using the powder puff device of the present invention as a portable element, the embodiment of FIG. 3 which utilizes a cap 30 is desirable. When used with home, beauty salon, make-up room, or the like, the user can use the powder puff device of the present invention without a cap 30, as shown in FIGS. 1 and 2.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. A powder puff device which comprises:

a powder puff;

a porous protective cover, covering the powder puff;

a receptacle for storing a cosmetic powder, said receptacle being detachably connected to the porous protective cover; and means for channeling the cosmetic powder directly from the receptacle to a surface of said protective cover covering the powder puff.

2. The powder puff device of claim 1, wherein said protective cover has a porosity sufficient to disperse the cosmetic powder from the surface thereof.

3. The powder puff device of claim 1, wherein the channeling means communicates with a small chamber provided at the surface of the powder puff for dispersing the cosmetic powder at said surface.

4. The powder puff device of claim 1, wherein a cap which is adapted to cover the powder puff is engageable with the receptacle.

5. The powder puff device of claim 4, wherein the outside of the cap is provided with a mirror.

6. The powder puff device of claim 5, wherein the inside of the cap is provided with a mirror.

7. A powder puff device comprising:

a receptacle containing a powder puff;

a cap containing a solid cosmetic mounted therein so that when the cap is attached to the receptacle, the cosmetic is biased against the surface of the powder puff for transferring cosmetics to the powder puff;

a spring attached at one end to the inside of the cap and at the other end to the cosmetic receptacle for biasing the cosmetic against the powder puff when the cap is closed in the receptacle; and a mirror provided on the outside of the cap.

8. The powder puff device of claim 7, wherein said other end of the spring as freely engageable with the cosmetic receptacle.

9. The powder puff device of claim 8, wherein the inside of the cap is provided with a mirror.

* * * * *